US011873180B2

(12) United States Patent
Chang

(10) Patent No.: US 11,873,180 B2
(45) Date of Patent: Jan. 16, 2024

(54) PAPER SEPARATING ROLLER, PAPER TRANSMITTING DEVICE, AND OFFICE MACHINE USING THE SAME

(71) Applicant: AVISION INC., Hsinchu (TW)

(72) Inventor: Min-Hao Chang, Hsinchu (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 17/696,918

(22) Filed: Mar. 17, 2022

(65) Prior Publication Data

US 2022/0315360 A1 Oct. 6, 2022

(30) Foreign Application Priority Data

Mar. 30, 2021 (TW) ..... 110111539

(51) Int. Cl.
*B65H 3/06* (2006.01)
*B65H 5/06* (2006.01)

(52) U.S. Cl.
CPC ..... *B65H 3/0653* (2013.01); *B65H 3/0638* (2013.01); *B65H 2404/10* (2013.01); *B65H 2404/539* (2013.01)

(58) Field of Classification Search
CPC ..... B65H 3/06; B65H 3/0638; B65H 3/0661; B65H 3/0653; B65H 5/06; B65H 2404/1321; B65H 2404/539; B65H 2404/5311; B65H 2404/531; B65H 2404/532; B65H 2404/5322; B65H 27/00
See application file for complete search history.

(56) References Cited

U.S. PATENT DOCUMENTS 5,267,008 A * 11/1993 Rebres ..... G03G 15/65 399/388
7,464,923 B2 * 12/2008 Faguy ..... B65H 3/5261 271/275
2013/0328260 A1 * 12/2013 Matsushita ..... B65H 3/063 271/109

(Continued)

FOREIGN PATENT DOCUMENTS

CN 211110079 U 7/2020
CN 212219684 U * 12/2020
CN 212499538 U 2/2021

(Continued)

OTHER PUBLICATIONS

Office Action issued by Taiwan Intellectual Property Office dated Sep. 28, 2021.

(Continued)

*Primary Examiner* — Luis A Gonzalez
(74) *Attorney, Agent, or Firm* — WPAT, P.C

(57) ABSTRACT

A paper separating roller, including a shaft body, a first friction member and a second friction member is provided. The first friction member covers a first surface of an outer periphery of the shaft body. The second friction member covers a second surface of the outer periphery of the shaft body, wherein the first friction member and the second friction member are formed of two different materials. With the design of the friction members being formed of composite materials, the paper separating roller has the advantages of two different material features at the same time, such that a wider range of performance capabilities can be achieved.

8 Claims, 7 Drawing Sheets

(56) References Cited

U.S. PATENT DOCUMENTS

2014/0110898 A1* 4/2014 Hung ..... B65H 1/24
271/10.11

FOREIGN PATENT DOCUMENTS

| | | | | |
|---|---|---|---|---|
| JP | 08239132 | A | * | 9/1996 |
| TW | 200516004 | A | | 5/2005 |
| TW | 202010650 | A | | 3/2020 |

OTHER PUBLICATIONS

Office Action issued by Taiwan Intellectual Property Office dated Apr. 29, 2022.

* cited by examiner

PAPER SEPARATING ROLLER, PAPER TRANSMITTING DEVICE, AND OFFICE MACHINE USING THE SAME

This application claims the benefit of Taiwan application Serial No. 110111539, filed Mar. 30, 2021, the subject matter of which is incorporated herein by reference.

BACKGROUND OF THE INVENTION

Field of the Invention

The invention relates in general to a paper separating roller, a paper transmitting device and an office machine using the same.

Description of the Related Art

In the office, paperwork can be processed with office automation machines such as facsimile machine (Fax), scanner, photocopier and printer. These machines can be integrated as a multi-function printer (MFP) to save space. Generally speaking, the office machine includes a paper separating roller. When the paper separating roller touches a paper, a friction is generated between the paper and the paper separating roller, so that the paper can be driven to move along a transmission direction.

However, the used material of the current paper separating roller has unique feature, therefore the paper separating roller formed of each material has respective performance capability and cannot be adapted to different environments. Therefore, it has become a prominent task for the industries to provide a paper separating roller that can be adapted to different environments.

SUMMARY OF THE INVENTION

The invention is directed to a paper separating roller having the advantages of more than two features for increasing the performance capabilities of the paper separating roller.

According to one embodiment of the present invention, a paper separating roller, including a shaft body, a first friction member and a second friction member, is provided. The first friction member covers a first surface of an outer periphery of the shaft body. The second friction member covers a second surface of the outer periphery of the shaft body, wherein the first friction member and the second friction member are formed of two different materials.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention. Similar/identical designations are used to indicate similar/identical elements. Directional terms such as above, under, left, right, front or back are used in the following embodiments to indicate the directions of the accompanying drawings, not for limiting the present invention.

Figure 1:
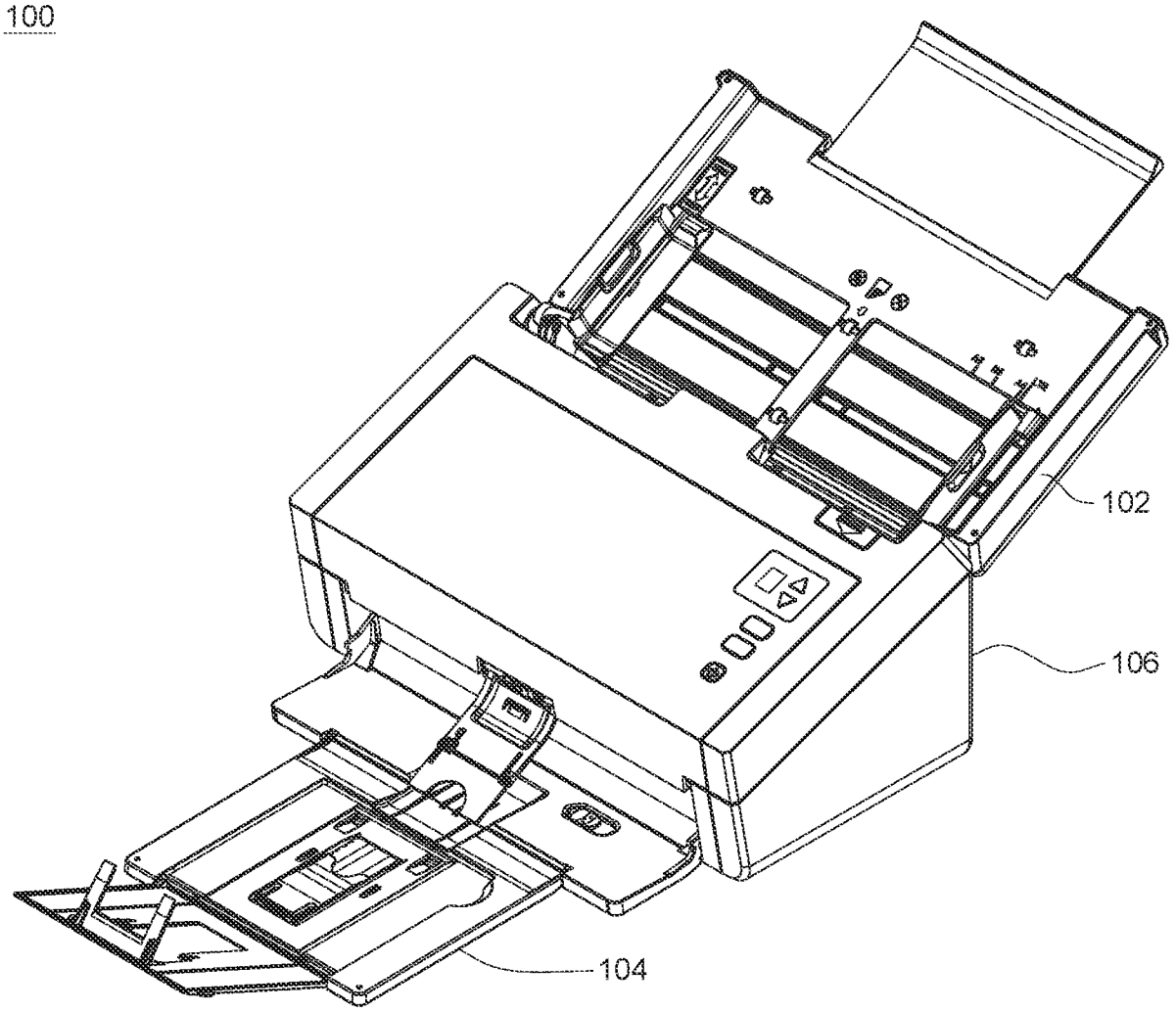
FIG. 1 is a perspective diagram of an office machine according to an embodiment of the present invention.

Referring to FIG. 1, a perspective diagram of an office machine 100 according to the present invention an embodiment is shown. The office machine 100 includes a input tray 102, an output tray 104 and a paper transmitting device 108 located inside the body 106 (illustrated in FIGS. 2A and 2B). The input tray 102 is located on one side the office machine 100 for placing several pieces of paper stacked thereon, and the paper can be sequentially transmitted to the office machine 100 via the input tray 102.

Figure 2A:
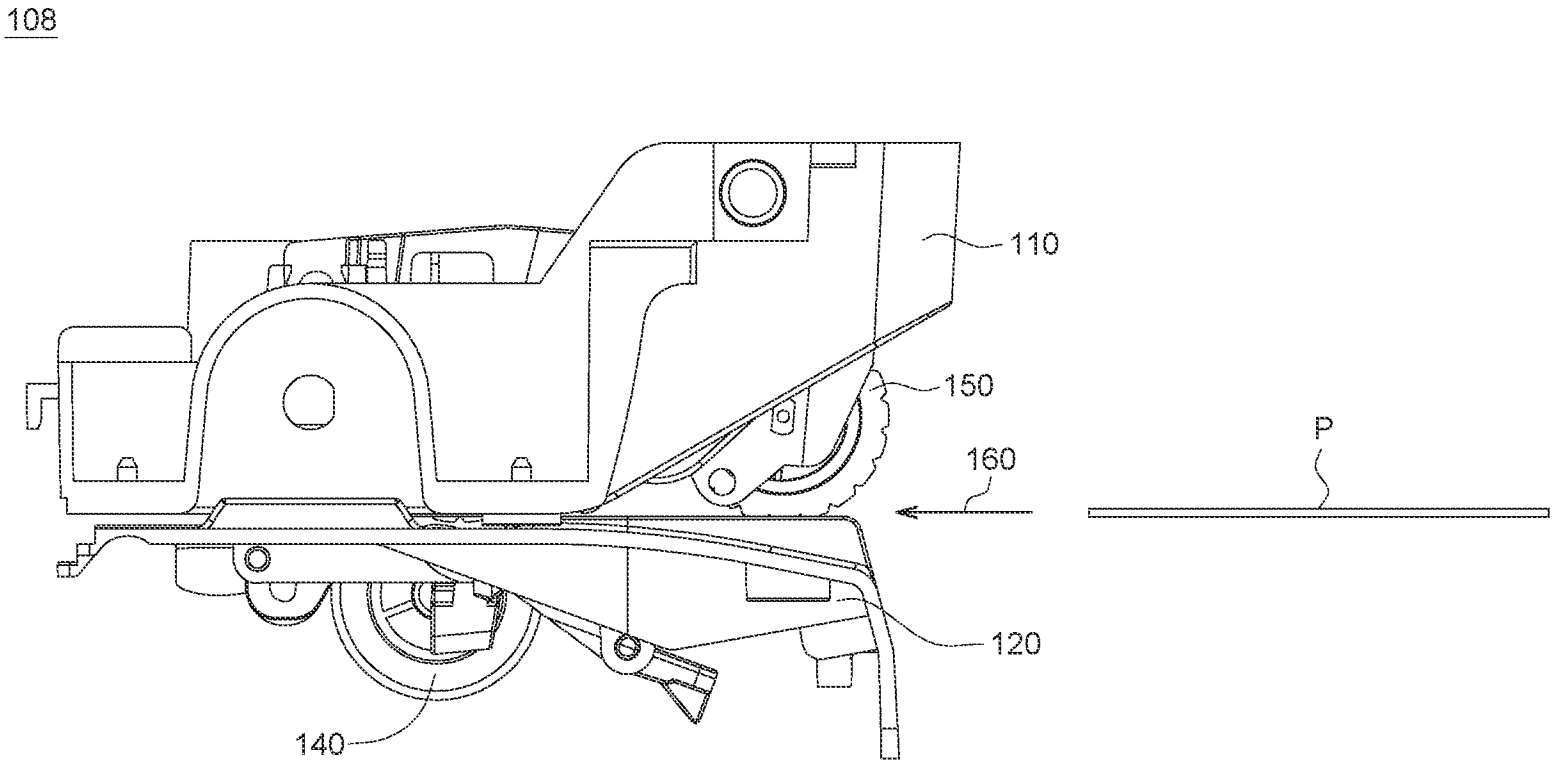
FIG. 2A is a perspective diagram of a paper transmitting device according to an embodiment of the present invention.
Figure 2B:
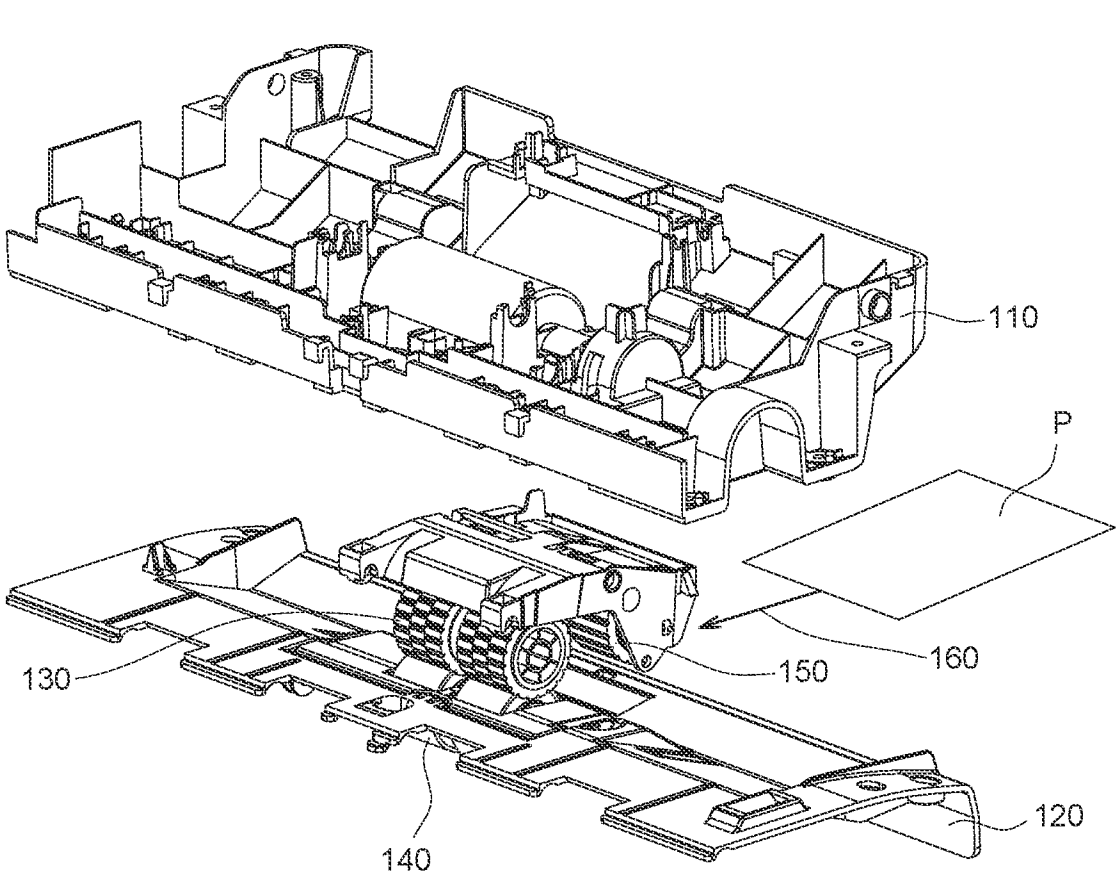
FIG. 2B is an explosion diagram of the paper transmitting device of FIG. 2A.

Referring to FIG. 2A and FIG. 2B, a perspective diagram and an explosion diagram of a paper transmitting device 108 according to the present invention an embodiment are shown. The paper transmitting device 108 is disposed in the body 106 of the office machine 100. The paper transmitting device 108 includes an upper casing 110, a stopper 120, a paper separating roller 130, a friction roller 140, a transmission roller 150 and a transmission channel 160. The transmission channel 160 is located between the upper casing 110 and the stopper 120. In an embodiment, the paper separating roller 130 and the transmission roller 150 are disposed on the upper casing 110; the friction roller 140 is disposed on the stopper 120; the paper separating roller 130 and the friction roller 140 are opposite to the transmission channel 160; the paper separating roller 130, when touching a paper P, rotates and moves the paper P along the transmission channel 160. In another embodiment, the vertical arrangement of the paper separating roller 130 and the friction roller 140 can be swapped; that is, the friction roller 140 and the transmission roller 150 are disposed on the upper casing 110, and the paper separating roller 130 is disposed on the stopper 120, and the present invention does not have specific restrictions regarding the said arrangement. The transmission roller 150 transmits the paper P to the interior of the office machine 100 along the transmission channel 160. Thus, several pieces of paper P located on the input tray 102 are transmitted to the office machine 100 along the transmission channel 160 by the transmission roller 150, then the paper separating roller 130 and the friction roller 140 cooperate to separate these pieces of paper P, so that each time only one piece of paper P is allowed to pass between the paper separating roller 130 and the friction roller 140 to enter the office machine 100. The above disclosure only illustrates the paper transmitting device 108 and the office machine 100 using the paper separating roller 130. The advantages of the paper separating roller 130 are disclosed below.

Figure 3A:
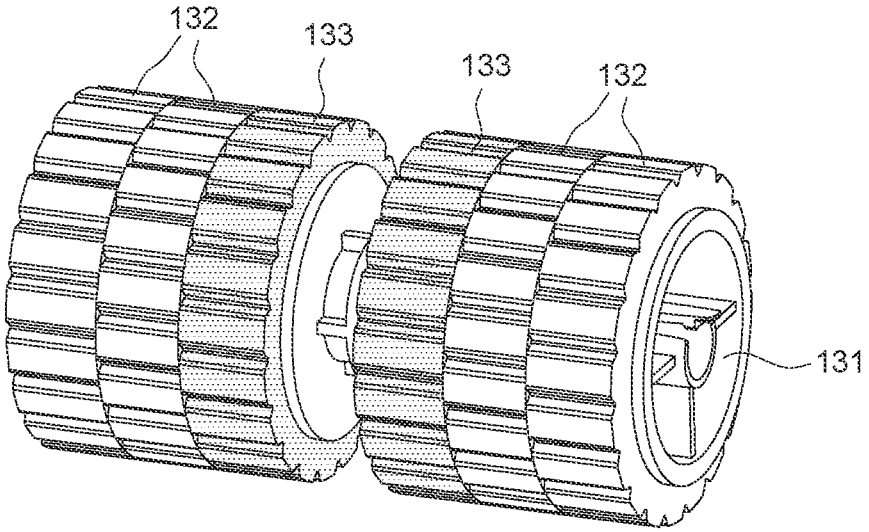
FIG. 3A is a schematic diagram of a paper separating roller according to an embodiment of the present invention.

Referring to FIG. 3A, a perspective diagram of a paper separating roller 130 according to an embodiment of the present invention is shown. The paper separating roller 130 includes a shaft body 131, a first friction member 132 and a second friction member 133. The first friction member 132 covers a first surface S1 of an outer periphery of the shaft body 131. The second friction member 133 covers a second surface S2 of an outer periphery of the shaft body 131. The first friction member 132 and the second friction member 133 are formed of two different materials. More specifically, the first friction member 132 and the second friction member 133 are formed different elastic materials. With the design of the first friction member 132 and the second friction member 133 being formed of composite materials, the paper separating roller 130 can have the advantages of two different material features at the same time, so that a wider range of performance capabilities can be achieved.

In an embodiment, the first friction member 132 and the second friction member 133 are adjacently mounted on an outer periphery surface of the shaft body 131 (i.e., the first surface S1 and the second surface S2). When one of the first friction member 132 and the second friction member 133 is frequently used and worn out due to friction, only the worn-out friction member of the first friction member 132 and the second friction member 133 needs to be replaced, and there is no need to replace both the first friction member 132 and the second friction member 133 or replace the entire paper separating roller 130.

In an embodiment, the first friction member 132 and the second friction member 133 are formed of two different elastic materials. The first friction member 132 has a first abrasion resistance, the second friction member has a second abrasion resistance different from the first abrasion resistance, and the first abrasion resistance of the first friction member 132 is greater than the second abrasion resistance of the second friction member 133. In another embodiment, the first friction member 132 further has a first low-temperature resistance, the second friction member 133 further has a second low-temperature resistance different from the first low-temperature resistance, and the first low-temperature resistance of the first friction member 132 is smaller than the second low-temperature resistance of the second friction member 133. The material with inferior low-temperature resistance (such as the first friction member 132 whose first low-temperature resistance is smaller than the second low-temperature resistance) may easily deteriorate (hardening) in a low-temperature state (such as 5~10° C.), hence causing a reduced friction, leading to a deteriorated paper gripping ability. To the worse, the material may deteriorate to an unusable state. The material with superior low-temperature resistance (such as the second friction member 133 whose second low-temperature resistance is greater than the first low-temperature resistance) will not easily deteriorate even in a low-temperature state (such as 5~10° C.) and will maintain superior friction and paper gripping ability. That is, in the low-temperature state (such as 5~10° C.), the material with superior low-temperature resistance has superior friction and paper gripping ability than the material with inferior low-temperature resistance. Thus, the paper separating roller 130 can have both advantages of the first friction member 132 and the second friction member 133, and possess suitable abrasion resistance and suitable low-temperature resistance. Thus, even when the paper separating roller 130 is used in a low-temperature environment (about 5~10° C.), since the second friction member 133 of the paper separating roller 130 has superior low-temperature resistance than the first friction member 132, the paper separating roller 130 also possesses excellent low-temperature performance capabilities; since the first friction member 132 of the paper separating roller 130 has superior abrasion resistance than the second friction member 133, the paper separating roller 130 also possesses excellent abrasion resistance.

In an embodiment, the first friction member 132 can be selected from ethylene-propylene rubber (EPDM), natural rubber (NR), nitrile rubber (NBR), polyurethane rubber (PU) or silicone, the second friction member 133 can be selected from ethylene-propylene rubber (EPDM), natural rubber (NR), nitrile rubber (NBR), polyurethane rubber (PU) or silicone, wherein the first friction member 132 and the second friction member 133 are formed of two different elastic materials. In an embodiment, the first friction member 132 can be an elastic member with superior abrasion resistance, such as ethylene-propylene rubber (EPDM). In an embodiment, the second friction member 133 can be an elastic member with superior low-temperature resistance, such as silicone. As illustrated in Table 1, in an embodiment, the surface friction of the paper separating roller formed of only ethylene-propylene rubber (EPDM) material will drop at a low temperature (about 5~10° C.), and cause delayed paper feed, which will occur after about 1000 pieces of paper are scanned. In an embodiment, the paper separating roller formed of only silicone material has superior low-temperature resistance, and has excellent performance capabilities even at a low temperature, and delayed paper feed will occur only after about 8000 pieces of paper are scanned. Besides, the paper separating roller formed of composite materials including ethylene-propylene rubber (EPDM) and silicone has the advantage of silicone material, that is, the paper separating roller possesses excellent performance capabilities at a low temperature, and delayed paper feed occurs only after about 8000 pieces of paper are scanned.

TABLE 1

| Material of the friction member of the paper separating roller | Number of pieces of paper scanned when delayed paper feed occurs at a low temperature (about 5~10° C.) |
|---|---|
| Ethylene-propylene rubber (EPDM) material | About 1000 pieces of paper |
| Silicone material | About 8000 pieces of paper |
| Composite materials including ethylene-propylene rubber (EPDM) and silicone | About 8000 pieces of paper |

As illustrated in Table 2, in an embodiment, the paper separating roller formed of only ethylene-propylene rubber (EPDM) material has superior abrasion resistance, and can scan about 300000 pieces of paper. In an embodiment, the paper separating roller formed of only silicone material has inferior abrasion resistance, and can scan only about 50000 pieces of paper. In an embodiment, the paper separating roller formed of composite materials including ethylene-propylene rubber (EPDM) and silicone has the advantage of the ethylene-propylene rubber (EPDM) material, and can scan about 300000 pieces of paper.

TABLE 2

| Material of the friction member of the paper separating roller | Lifespan |
|---|---|
| Ethylene-propylene rubber (EPDM) material | About 300000 pieces of paper |
| Silicone material | About 50000 pieces of paper |
| Composite materials including ethylene-propylene rubber (EPDM) and silicone | About 300000 pieces of paper |

As disclosed above, the paper separating roller formed of only ethylene-propylene rubber (EPDM) material has inferior performance capabilities at a low temperature and can hardly be adaptably used in a low-temperature environment. The paper separating roller formed of only silicone material has inferior abrasion resistance and a shorter lifespan. Thus, the paper separating roller formed of composite materials including ethylene-propylene rubber (EPDM) and silicone have the advantages of both materials, that is, a longer lifespan and adaptability to a low-temperature environment, and can achieve a wider range of performance capabilities.

In an embodiment, a first area ratio of the first friction member 132 on the outer periphery surface of the shaft body 131 is greater than a second area ratio of the second friction member 133 on the outer periphery surface of the shaft body 131, and the ratio of the first area ratio to the second area ratio can be greater than 1, such as 1.2, 1.5, 2, 2.5, 3, 3.5, 4, 4.5 or 5. That is, in an embodiment, the paper separating roller 130 can be divided into two portions; the portion with a larger ratio is formed of ethylene-propylene rubber (EPDM) material for providing with superior abrasion resistance and the portion with a smaller ratio is formed of silicone material, so that a wider range of performance capabilities can be achieved, that is, the paper separating roller 130 can increase performance capabilities at a low temperature and maintain excellent lifespan at the same time.

Figure 6:
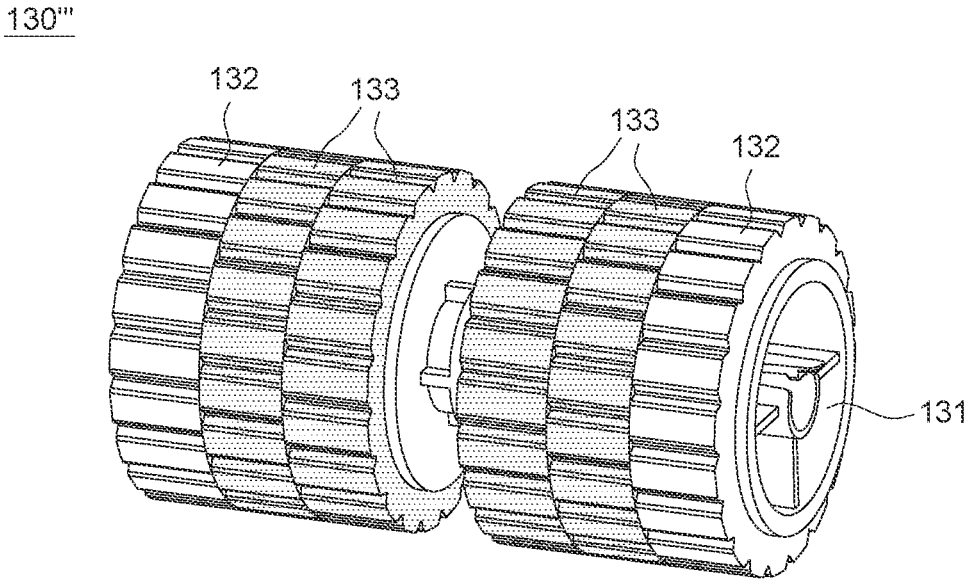
FIG. 6 is a schematic diagram of a first friction member and a second friction member arranged on a paper separating roller according to another embodiment of the present invention.

In another embodiment, the first area ratio of the first friction member 132 on the outer periphery surface of the shaft body 131 is equivalent to the second area ratio of the second friction member 133 on the outer periphery surface of the shaft body 131. Or, in an alternate embodiment, the first area ratio of the first friction member 132 on the outer periphery surface of the shaft body 131 is smaller than the second area ratio of the second friction member 133 on the outer periphery surface of the shaft body 131, and the ratio of the first area ratio to the second area ratio can be smaller than 1 (referring to FIG. 6), such as 0.83, 0.66, 0.5, 0.4, 0.28, 0.25, 0.22 or 0.2. Take the paper separating roller 130''' of FIG. 6 for example. The ratio of the first area ratio of the first friction member 132 to the second area ratio of the second friction member 133 is 0.5. That is, based on actual needs, the ratios of the first friction member 132 and the second friction member 133 on the outer periphery surface of the shaft body 131 can be adjusted.

As illustrated in Table 3, in an embodiment, when all friction member material of the paper separating roller is ethylene-propylene rubber (EPDM), about 500000 pieces of paper can be scanned. In an embodiment, when the ratio of ethylene-propylene rubber (EPDM) material to silicone material is 2, about 500000 pieces of paper can be scanned. In an embodiment, when the ratio of ethylene-propylene rubber (EPDM) material to silicone material is 0.5, about 300000 pieces of paper can be scanned. Thus, in the paper separating roller formed of composite materials including ethylene-propylene rubber (EPDM) and silicone, the portion with a larger ratio is formed on ethylene-propylene rubber (EPDM) material for providing with superior abrasion resistance and the portion with a smaller ratio is formed of silicone material the paper separating roller 130 for increasing the performance capabilities at a low temperature (about 5-10° C.) and maintaining excellent lifespan, so that a wider range of performance capabilities can be achieved.

TABLE 3

| Material of the friction member of the paper separating roller | Lifespan at a low temperature (about 5~10° C.) |
|---|---|
| All material is ethylene-propylene rubber (EPDM) | About 500000 pieces of paper |
| The ratio of ethylene-propylene rubber (EPDM) material to silicone material is 2 | About 500000 pieces of paper |
| The ratio of ethylene-propylene rubber (EPDM) material to silicone material is 0.5 | About 300000 pieces of paper |

Figure 3B:
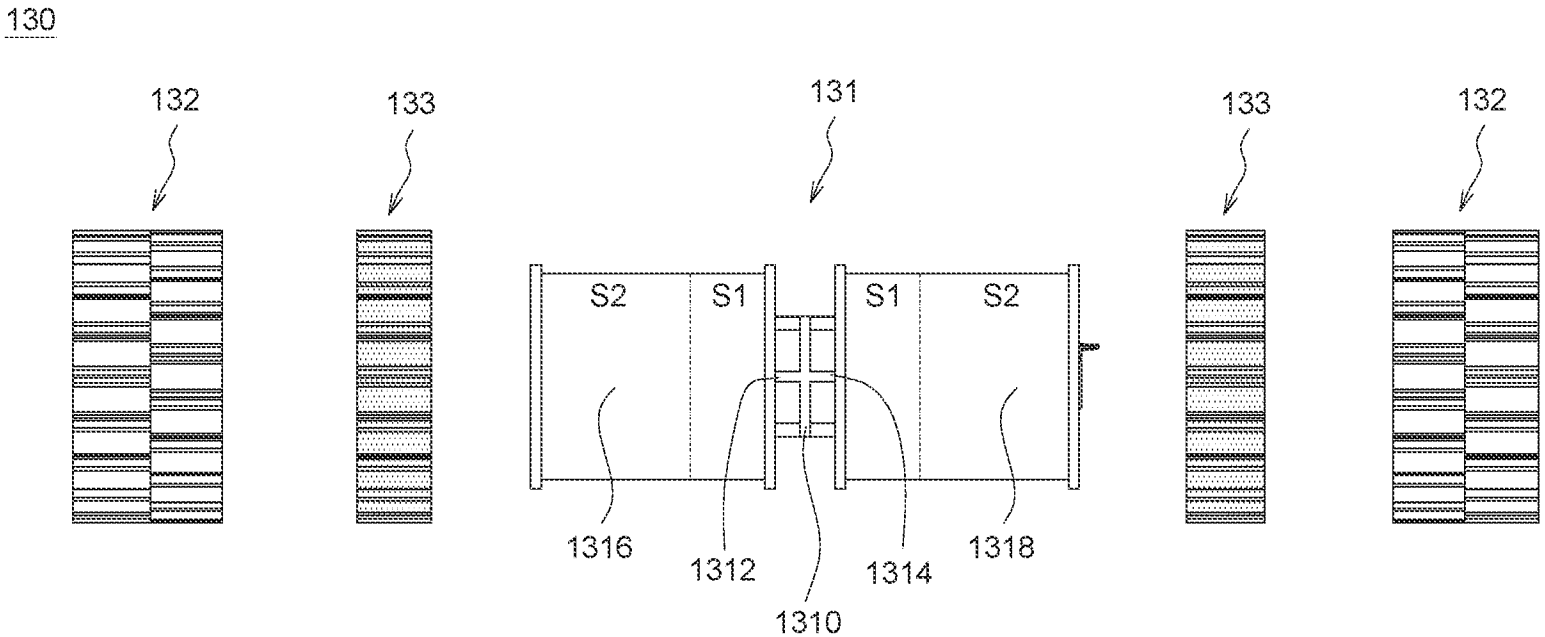
FIG. 3B is an explosion diagram of a paper separating roller according to an embodiment of the present invention.

Referring to FIG. 3B, an explosion diagram of a paper separating roller 130 according to an embodiment of the present invention is shown. The shaft body 131 includes a central pivot 1310, a first column 1316 and a second column 1318. The first column 1316 is located on a first side 1312 of the central pivot 1310. The second column 1318 is located on a second side 1314 of the central pivot 1310. The first side 1312 and the second side 1314 are opposite to each other. Both of the first column 1316 and the second column 1318 have an outer periphery surface (that is, the first surface S1 and the second surface S2). Additionally, a first distribution of the first friction member 132 and the second friction member 133 on the first column 1316 is symmetric to a second distribution of the first friction member 132 and the second friction member 133 on the second column 1318. The terminology "distribution" here refers to the arrangement pattern of the first friction member 132 and the second friction member 133, and when the arrangement pattern of the first friction member 132 and the second friction member 133 is changed, respective area ratio of the first friction member 132 and the second friction member 133 may be changed accordingly. With the symmetric distribution, the paper separating roller 130 can stably provide paper with symmetric friction, hence avoiding paper jam.

Figure 4:
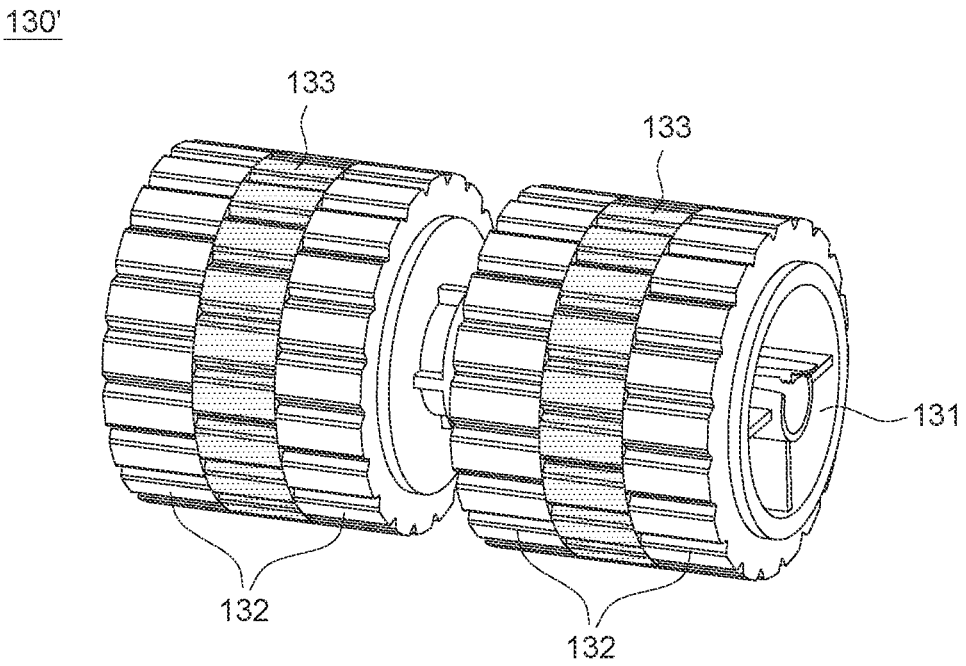
FIG. 4 is a schematic diagram of a first friction member and a second friction member arranged on a paper separating roller according to another embodiment of the present invention.
Figure 5:
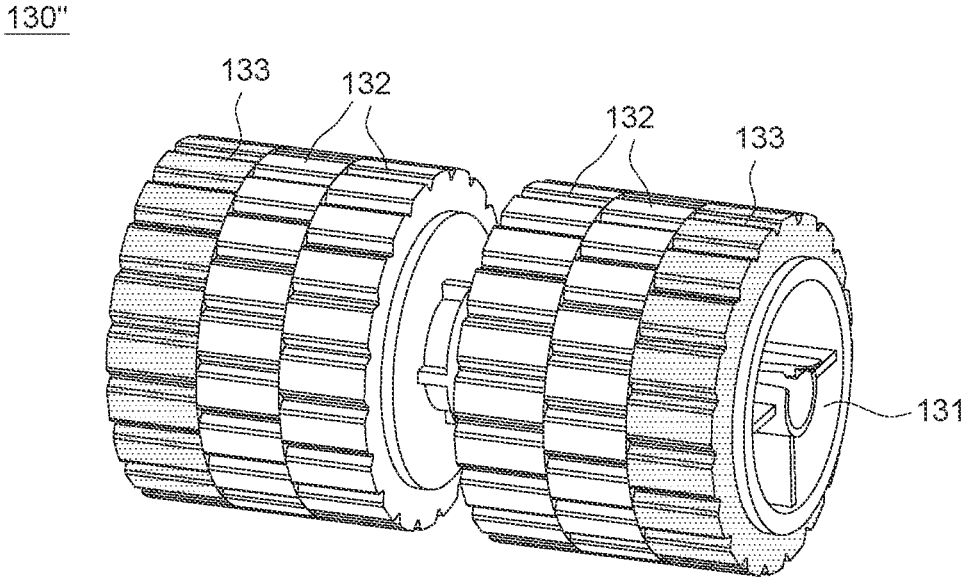
FIG. 5 is a schematic diagram of a first friction member and a second friction member arranged on a paper separating roller according to an alternate embodiment of the present invention.

Referring to FIG. 3A, FIG. 4 and FIG. 5, configured positions of the second friction member 133 on the paper separating roller are shown. In an embodiment, the second friction member 133 is distributed over the inner region of the first column 1316 and the second column 1318 closer to the central pivot 1310 as illustrated in the paper separating roller 130 of FIG. 3A and FIG. 3B. Or, in another embodiment, the second friction member 133 is distributed over the central region of the first column 1316 and the second column 1318 as illustrated in the paper separating roller 130' of FIG. 4. Or, in an alternate embodiment, the second friction member 133 is distributed over the outer region of the first column 1316 and the second column 1318 farther away from the central pivot 1310 as illustrated in the paper separating roller 130" of FIG. 5. That is, the present invention does not restrict the configured position of the paper separating roller on the second friction member 133.

As the season or environment changes, the paper separating roller formed of single material friction member cannot be adapted to each change. The present invention provides a paper separating roller whose friction member is formed of composite materials. Thus, the paper separating roller has the advantages of each material at the same time, such that a wider range of performance capabilities is achieved. In a low-temperature environment (about 5~10° C.), the paper separating roller formed of composite materials including ethylene-propylene rubber (EPDM) and silicone can maintain excellent abrasion resistance of ethylene-propylene rubber (EPDM) material and the low-temperature performance of silicone material, and therefore provide a wider range of performance capabilities than the paper separating roller formed of single material friction member.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A paper separating roller, comprising:

a shaft body having an outer periphery;

a first friction member covering a first surface of the outer periphery of the shaft body; and a second friction member covering a second surface of the outer periphery of the shaft body, wherein the first friction member and the second friction member are formed of two different materials, wherein the shaft body has a central pivot, a first column and a second column, the first column is located on a first side of the central pivot, the second column is located on a second side of the central pivot, the first side and the second side are opposite to each other, and the first column and the second column both have the first surface and the second surface, wherein a first distribution of the first friction member and the second friction member on the first column is symmetric to a second distribution of the first friction member and the second friction member on the second column, wherein the first friction member and the second friction member are two different elastic materials, the first friction member has a first abrasion resistance, the second friction member has a second abrasion resistance different from the first abrasion resistance, and the first abrasion resistance of the first friction member is greater than the second abrasion resistance of the second friction member.

2. The paper separating roller according to claim 1, wherein the first friction member and the second friction member are adjacently mounted on the first surface and the second surface of the shaft body.

3. The paper separating roller according to claim 1, wherein the first friction member further has a first low-temperature resistance, the second friction member further has a second low-temperature resistance different from the first low-temperature resistance, and the first low-temperature resistance of the first friction member is smaller than the second low-temperature resistance of the second friction member.

4. The paper separating roller according to claim 3, wherein the first friction member is selected from ethylene-propylene rubber (EPDM), polyurethane rubber (PU), natural rubber (NR) or nitrile rubber (NBR); the second friction member is selected from silicone.

5. The paper separating roller according to claim 1, wherein the first friction member is selected from ethylene-propylene rubber (EPDM), polyurethane rubber (PU), natural rubber (NR) or nitrile rubber (NBR); the second friction member is selected from silicone.

6. The paper separating roller according to claim 1, wherein a first area ratio of the first friction member on the shaft body is greater than a second area ratio of the second friction member on the shaft body.

7. A paper transmitting device, comprising:

a transmission channel;

a friction roller located on one side of the transmission channel to drive a paper; and the paper separating roller according to claim 1 opposite to the friction roller and located on an opposite side of the transmission channel, wherein the paper separating roller enables the paper to pass between the friction roller and the paper separating roller and move along the transmission channel.

8. An office machine, comprises:

a body; and the paper separating roller according to claim 1, wherein the paper separating roller is disposed on the body.

* * * * *